US008174481B2

(12) United States Patent
Huang

(10) Patent No.: US 8,174,481 B2
(45) Date of Patent: May 8, 2012

(54) DRIVING CIRCUIT OF LIQUID CRYSTAL DISPLAY

(75) Inventor: Ju-Lin Huang, Hsinchu County (TW)

(73) Assignee: Novatek Microelectronics Corp., Hisnchu (TW)

( * ) Notice: Subject to any disclaimer, the term of this patent is extended or adjusted under 35 U.S.C. 154(b) by 296 days.

(21) Appl. No.: 12/690,087

(22) Filed: Jan. 19, 2010

(65) Prior Publication Data

US 2011/0069053 A1 Mar. 24, 2011

(30) Foreign Application Priority Data

Sep. 23, 2009 (TW) ..... 98132120 A

(51) Int. Cl.
*G09G 3/36* (2006.01)

(52) U.S. Cl. ..... 345/100; 345/89

(58) Field of Classification Search ..... 345/87, 345/89, 94, 95, 98–100
See application file for complete search history.

(56) References Cited

U.S. PATENT DOCUMENTS

| | | | | |
|---|---|---|---|---|
| 2005/0007334 | A1* | 1/2005 | Park | 345/102 |
| 2007/0139328 | A1* | 6/2007 | Lan | 345/89 |
| 2008/0079706 | A1* | 4/2008 | Chia | 345/211 |
| 2008/0150930 | A1* | 6/2008 | Nam et al. | 345/212 |
| 2009/0109201 | A1* | 4/2009 | Kim et al. | 345/206 |
| 2010/0039453 | A1* | 2/2010 | Chaji et al. | 345/690 |

* cited by examiner

*Primary Examiner* — Ricardo L Osorio
(74) *Attorney, Agent, or Firm* — Jianq Chyun IP Office

(57) ABSTRACT

A driving circuit of a liquid crystal display including a first input port, a second input port, a first gamma buffer, a second gamma buffer, and a switching circuit is provided. A plurality of first gamma voltages are inputted from the first input port, and a plurality of second gamma voltages are inputted from the second input port. The switching circuit switches the connections between the two input ports and the two gamma buffers, such that a first line of pixels of the liquid crystal display receives the gamma voltages from the first gamma buffer within a first frame period and a second frame period, and that a second line of pixels of the liquid crystal display receives the gamma voltages from the second gamma buffer within the first frame period and the second frame period.

11 Claims, 15 Drawing Sheets

DRIVING CIRCUIT OF LIQUID CRYSTAL DISPLAY

CROSS-REFERENCE TO RELATED APPLICATION

This application claims the priority benefit of Taiwan application serial no. 98132120, filed on Sep. 23, 2009. The entirety of the above-mentioned patent application is hereby incorporated by reference herein and made a part of specification.

BACKGROUND OF THE INVENTION

1. Field of the Invention

The invention is generally related to a driving circuit of a liquid crystal display, and more particularly, to a driving circuit adapted to allow each line of pixels to receive gamma voltages from a same gamma buffer within each frame period.

2. Description of Related Art

With the rapid progress in video broadcasting and communication technology, liquid crystal display devices have been used as a display screen in many types of consumer electronic products such as the mobile phones, the notebook computers, the personal computers, and the personal digital assistants (PDAs). Since a liquid crystal display panel itself cannot emit light, it is necessary to dispose a backlight module behind the panel to serve as a light source required by the liquid crystal display panel. Moreover, the light transmittance of the liquid crystal panel is determined by the rotational angles of the liquid crystal molecules within the liquid crystal panel. In particular, the rotational angles of the liquid crystal molecules in the pixels are related to the voltage differences between the pixel electrodes of the pixels and the common electrode. Since the common electrode voltage is typically fixed, the pixel light transmittance can be controlled by manipulating the gamma voltages applied on the pixel electrodes.

Driving circuits of conventional liquid crystal displays utilize gamma buffers to stabilize the input of the gamma voltages. Ideally, an ideal gamma buffer has no output error. In other words, in view of the ideal gamma buffer, there is no difference between an input gamma voltage and an output gamma voltage. Referring to FIGS. 1 and 2, FIG. 1 is a diagram illustrating relationships between a DEV voltage of a driving circuit using an idealized gamma buffer and each graylevel. FIG. 2 is a diagram illustrating relationships between a root mean square (RMS) of a driving circuit using an idealized gamma buffer and each graylevel. The DEV voltage is defined as a difference value obtained by subtracting the gamma voltage outputted from the driving circuit by a predetermined idealized voltage. Each of the curves 30(1)-30(*n*) depicted in FIG. 1 represents a corresponding line of pixels of the liquid crystal display, respectively. Each of the curves 32(1)-32(*n*) also represents a corresponding line of pixels of the liquid crystal display, respectively. In different frame periods, the liquid crystal display outputs gamma voltages of different polarity. The left side and the right side of FIG. 1 illustrate the situations of the liquid crystal display at negative and positive polarity respectively.

However, because the driving circuits of the conventional liquid crystal displays utilize different gamma buffers to output gamma voltages for driving pixels, and because different errors exist between the input voltages and the output voltages of different gamma buffers, the display quality of the liquid crystal display deteriorates. Referring to FIGS. 3 and 4, FIG. 3 is a schematic diagram of a driving circuit 50 of a conventional liquid crystal display during a first frame period, and FIG. 4 is a schematic diagram of the driving circuit 50 during a second frame period. The driving circuit 50 has a first gamma buffer 52(1), a second gamma buffer 52(2), a plurality of digital-to-analog converters (DACs) 54(1)-54(*n*), and a plurality of operational amplifiers 56(1)-56(*n*). The driving circuit 50 is configured to output a plurality of gamma voltages to a plurality of lines of pixels 58(1)-58(*n*) in the liquid crystal display, so as to drive the liquid crystal molecules in the pixels to rotate. The first gamma buffer 52(1) receives a plurality of positive polarity gamma voltages, whereas the second gamma buffer 52(2) receives a plurality of negative polarity gamma voltages. The first gamma buffer 52(1) and the second gamma buffer 52(2) buffer and then output the gamma voltages received to the DACs 54(1)-54(*n*). Thereafter, according to display requirements, the DACs 54(1)-54(*n*) respectively select and thereafter output one corresponding gamma voltage of the gamma voltages transmitted from the first gamma buffer 52(1) and the second gamma buffer 52(2).

In the above-described first frame period, the odd-numbered DACs 54(1), . . . , 54(*n*−3), and 54(*n*−1) output positive polarity gamma voltages, whereas the even-numbered DACs 54(2), . . . , 54(*n*−2), and 54(*n*) output negative polarity gamma voltages. Moreover, in the above-mentioned second frame period, the odd-numbered DACs 54(1), . . . , 54(*n*−3), and 54(*n*−1) output negative polarity gamma voltages, whereas the even-numbered DACs 54(2), . . . , 54(*n*−2), and 54(*n*) output positive polarity gamma voltages.

However, during the first and second frame periods, because the gamma voltages received by pixels of a same line are respectively buffered by the first gamma buffer 52(1) and the second gamma buffer 52(2), whereby the first gamma buffer 52(1) and the second gamma buffer 52(2) have different errors (input voltages versus output voltages), the display quality of the liquid crystal display deteriorates. Referring to FIG. 5, FIG. 5 is a diagram illustrating relationships between the DEV voltage of the driving circuit 50 and each graylevel. The DEV voltage is defined as a difference value obtained by subtracting the gamma voltage the driving circuit 50 outputs to the pixels by a predetermined idealized voltage. A plurality of curves 60(1,−)-60(*n*,−) depicted in FIG. 5 represent the corresponding curves when the pixels receive negative polarity gamma voltages. A plurality of curves 60(1,+)-60(*n*,+) represent the corresponding curves when the pixels receive positive polarity gamma voltages. Compared with the idealized curves depicted in FIG. 1, the curves 60(1,−)-60(*n*,−) and 60(1,+)-60(*n*,+) depicted in FIG. 5 significantly deviate from the ideal case. Moreover, referring to FIG. 6, FIG. 6 is a diagram illustrating relationships between the RMS of the driving circuit 50 and each graylevel. Each of a plurality of curves 62(1)-62(*n*) respectively correspond to a line of the lines of pixels 58(1)-58(*n*). Compared with the curves depicted in FIG. 2, the curves 62(1)-62(*n*) depicted in FIG. 6 significantly deviate from the ideal case.

SUMMARY OF THE INVENTION

An aspect of the invention provides a driving circuit of a liquid crystal display. A plurality of gamma voltages transmitted to the liquid crystal display during different frame periods are buffered by a same gamma buffer, whereby the transmitted gamma voltages have substantially equal offset. Therefore, the display quality approaches an ideal condition.

Another aspect of the invention provides a driving circuit of a liquid crystal display. The above-mentioned driving circuit includes a first input port, a second input port, a switching circuit, a first gamma buffer, a second gamma buffer, a plurality of first digital-to-analog converters (DACs), a plurality of second DACs, a plurality of first operational amplifiers, and a plurality of second operational amplifiers. The first input port is adapted to input a plurality of first gamma voltages. The second input port is adapted to input a plurality of second gamma voltages. The switching circuit is coupled to the first input port and the second input port. The first gamma buffer is coupled to the switching circuit and adapted to receive the first gamma voltages or the second gamma voltages and to buffer then output the received first gamma voltages or the received second gamma voltages. The second gamma buffer is coupled to the switching circuit, and the second gamma buffer is adapted to receive the first gamma voltages or the second gamma voltages and to buffer then output the received first gamma voltages or the received second gamma voltages. The first DACs are coupled to an output port of the first gamma buffer and an output port of the second gamma buffer. The second DACs are coupled to the output port of the first gamma buffer and the output port of the second gamma buffer. The first operational amplifiers are coupled between the first DACs and a plurality of lines of first pixels of the liquid crystal display. The second operational amplifiers are coupled between the second DACs and a plurality of lines of second pixels of the liquid crystal display. During a first frame period of the liquid crystal display, the switching circuit couples the first input port to the first gamma buffer and couples the second input port to the second gamma buffer, the first DACs respectively select one of the first gamma voltages from the first gamma buffer to output to a corresponding one of the lines of the first pixels, the second DACs respectively select one of the second gamma voltages from the second gamma buffer to output to a corresponding one of the lines of the second pixels. During a second frame period of the liquid crystal display, the switching circuit couples the first input port to the second gamma buffer and couples the second input port to the first gamma buffer, the first DACs respectively select one of the second gamma voltages transmitted from the second gamma buffer to output to a corresponding one of the lines of the first pixels, and the second DACs respectively select one of the first gamma voltages from the first gamma buffer to output to a corresponding one of the lines of the second pixels.

Another aspect of the invention provides a driving circuit of a liquid crystal display. The aforementioned driving circuit includes a first input port, a second input port, a first switching circuit, a first gamma buffer, a second gamma buffer, a plurality of first DACs, a plurality of second DACs, a plurality of third switching circuits, a plurality of first operational amplifiers, and a plurality of second operational amplifiers. The first input port is adapted to input a plurality of first gamma voltages. The second input port is adapted to input a plurality of second gamma voltages. The first switching circuit is coupled to the first input port and the second input port. The first gamma buffer is coupled to the first switching circuit. The second gamma buffer is coupled to the first switching circuit. The second switching circuit is coupled to an output port of the first gamma buffer and an output port of the second gamma buffer. The first DACs are coupled to the second switching circuit. The second DACs are coupled to the second switching circuit. Each of the third switching circuits is coupled to a corresponding one of the first DACs and a corresponding one of the second DACs. The first operational amplifiers are coupled between the first DACs and a plurality of lines of first pixels of the liquid crystal display.

The second operational amplifiers are coupled between the second DACs and a plurality of lines of second pixels of the liquid crystal display. During the first frame period of the liquid crystal display, the first switching circuit couples the first input port to the first gamma buffer and couples the second input port to the second gamma buffer, the second switching circuit couples the first gamma buffer to the first DACs and couples the second gamma buffer to the second DACs, and the third switching circuits couple the first DACs to the first operational amplifiers and couple the second DACs to the second operational amplifiers. During the second frame period of the liquid crystal display, the first switching circuit couples the first input port to the second gamma buffer and couples the second input port to the first gamma buffer, the second switching circuit couples the first gamma buffer to the second DACs and couples the second gamma buffer to the first DACs, and the third switching circuits couple the first DACs to the second operational amplifiers and couple the second DACs to the first operational amplifiers.

In one embodiment of the invention, during the first frame period, the switching circuit disconnects the first input port from the second gamma buffer, and the switching circuit disconnects the second input port from the first gamma buffer. During the second frame period, the switching circuit disconnects the first input port from the first gamma buffer, and the switching circuit disconnects the second input port from the second gamma buffer.

In one embodiment of the invention during the first frame period, a polarity of the first line of pixels is a first polarity, and a polarity of the second line of pixels is a second polarity. During the second frame period, the polarity of the first line of pixels is the second polarity, and the polarity of the second line of pixels is the first polarity.

In one embodiment of the invention, the aforementioned first gamma voltages are greater than a common voltage, the aforementioned second gamma voltages are less than the common voltage, and a plurality of electrodes of the first pixels and the second pixels are coupled to the common voltage.

In one embodiment of the invention, the above-described first and second frame periods are not overlapped along the time axis.

In one embodiment of the invention, the above-described first DACs are P-type DACs configured to process positive polarity gamma voltages. The above-described second DACs are N-type DACs configured to process negative polarity gamma voltages.

In summary, a driving circuit of a liquid crystal display is provided. The gamma voltages transmitted to the liquid crystal display during different frame periods are buffered by the same gamma buffer, whereby the transmitted gamma voltages have substantially equal offset. Therefore, the display quality approaches an ideal condition.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 7:
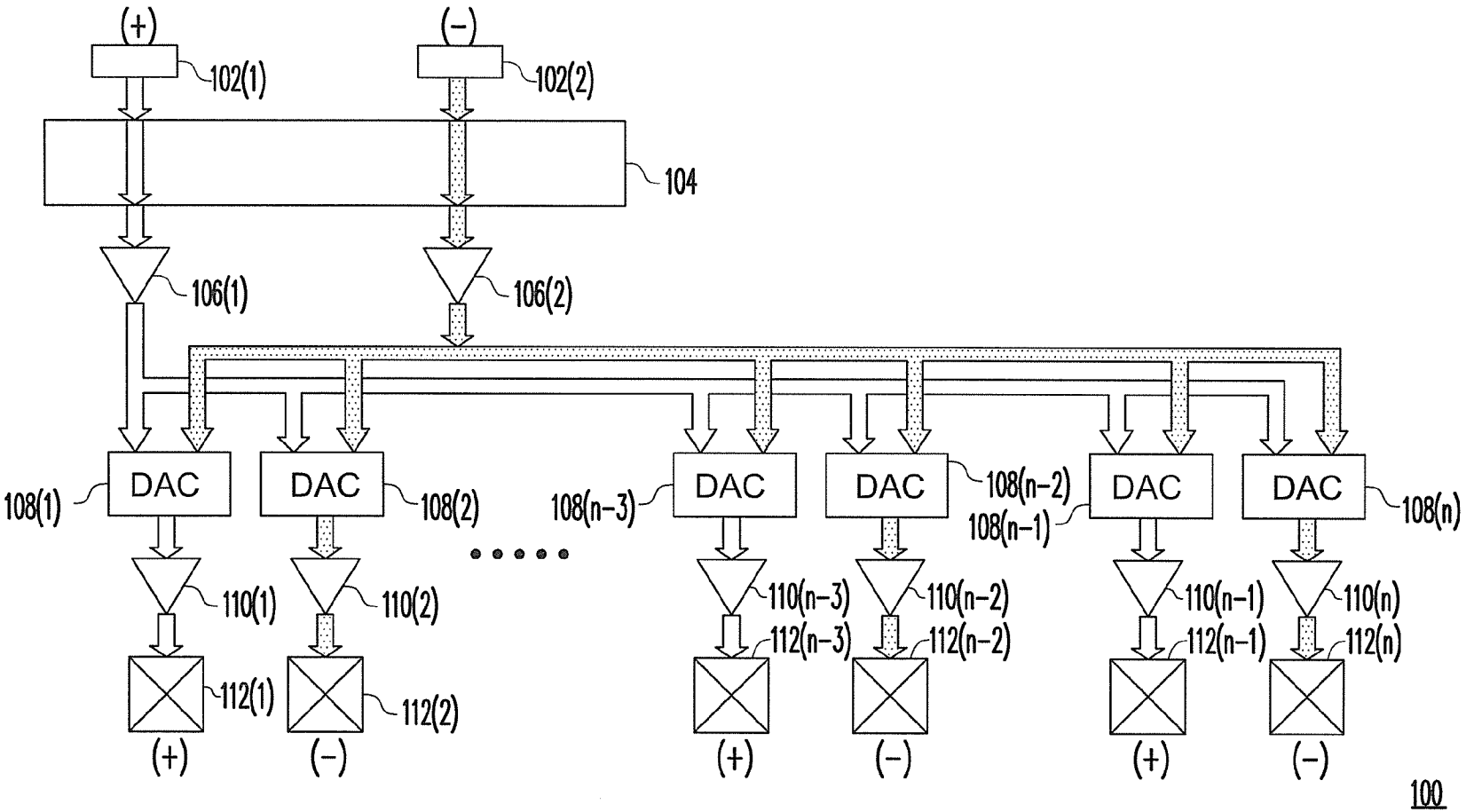
FIG. 7 is a schematic diagram of a driving circuit of a liquid crystal display during a first frame period in accordance with an embodiment of the invention.
Figure 8:
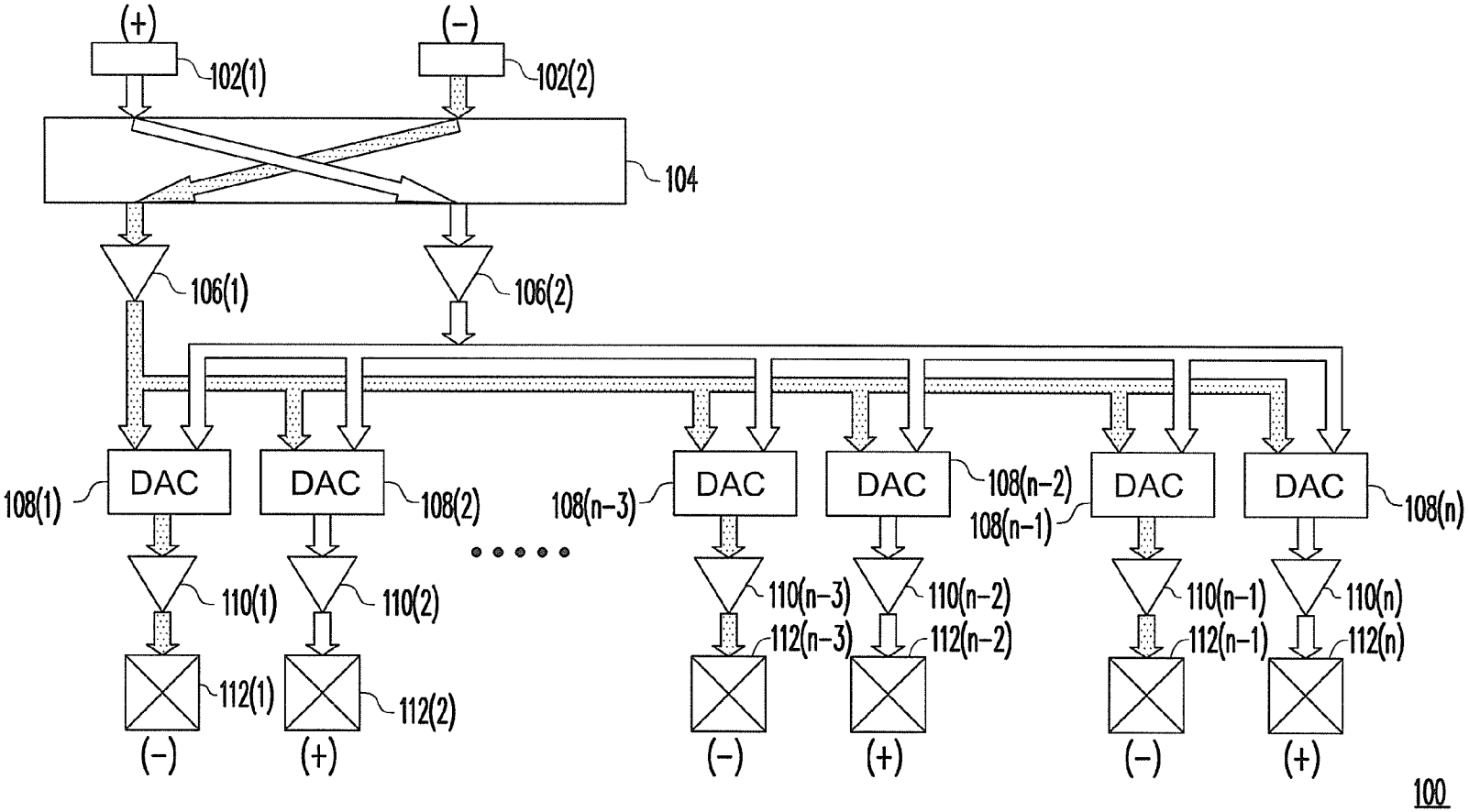
FIG. 8 is a schematic diagram of the driving circuit depicted in FIG. 7 during a second frame period.

Referring to FIGS. 7 and 8, FIG. 7 is a schematic diagram of a driving circuit 100 of a liquid crystal display during a first frame period in accordance with an embodiment of the invention. FIG. 8 is a schematic diagram of the driving circuit 100 during a second frame period. The driving circuit 100 has a first input port 102(1), a second input port 102(2), a switching circuit 104, a first gamma buffer 106(1), a second gamma buffer 106(2), a plurality of DACs 108(1)-108(*n*), and a plurality of operational amplifiers 110(1)-110(*n*). The driving circuit 100 is configured to output a plurality of gamma voltages to a plurality of lines of pixels 112(1)-112(*n*) in the liquid crystal display, so as to drive the liquid crystal molecules in the pixels to rotate.

For ease of description, in the embodiments described hereinafter, all the odd-numbered DACs 108(1), . . . , 108(*n*−3), and 108(*n*−1) of the DACs 108(1)-108(*n*) are referred to as the first DACs, and all the even-numbered DACs 108(2), . . . , 108(*n*−2), and 108(*n*) of the DACs 108(1)-108(*n*) are referred to as the second DACs. Moreover, all the odd-numbered operational amplifiers 110(1), . . . , 110(*n*−3), and 110(*n*−1) of the operational amplifiers 110(1)-110(*n*) are referred to as the first operational amplifiers, and all the even-numbered operational amplifiers 110(2), . . . , 110(*n*−2), and 110(*n*) of the operational amplifiers 110(1)-110(*n*) are referred to as the second operational amplifiers. In addition, the odd-numbered lines of pixels in the lines of pixels 112(1)-112(*n*) are referred to as the first pixels, and the even-numbered lines of pixels in the lines of pixels 112(1)-112(*n*) are referred to as the second pixels.

The first input port 102(1) is adapted to input a plurality of first gamma voltages, and the second input port 102(2) is adapted to input a plurality of second gamma voltages. In the present embodiment of the invention, the aforementioned first gamma voltages are positive polarity voltages, whereas the aforementioned second gamma voltages are negative polarity voltages. However, the invention should not be construed as limited thereto. For example, in another embodiment of the invention, the aforementioned first gamma voltages are negative polarity voltages, whereas the aforementioned second gamma voltages are positive polarity voltages.

The switching circuit 104 is coupled to the first input port 102(1) and the second input port 102(2). The switching circuit 104 performs switching during different frame periods of the liquid crystal display to appropriately transmit the aforementioned first gamma voltages and the second gamma voltages to the first gamma buffer 106(1) and the second gamma buffer 106(2). More specifically, as shown in FIG. 7, during the first frame period of the liquid crystal display, the switching circuit 104 couples the first input port 102(1) to the first gamma buffer 106(1), and couples the second input port 102(2) to the second gamma buffer 106(2). Moreover, as shown in FIG. 8, during the second frame period of the liquid crystal display, the switching circuit 104 couples the first input port 102(1) to the second gamma buffer 106(2), and couples the second input port 102(2) to the first gamma buffer 106(1).

Figure 9:
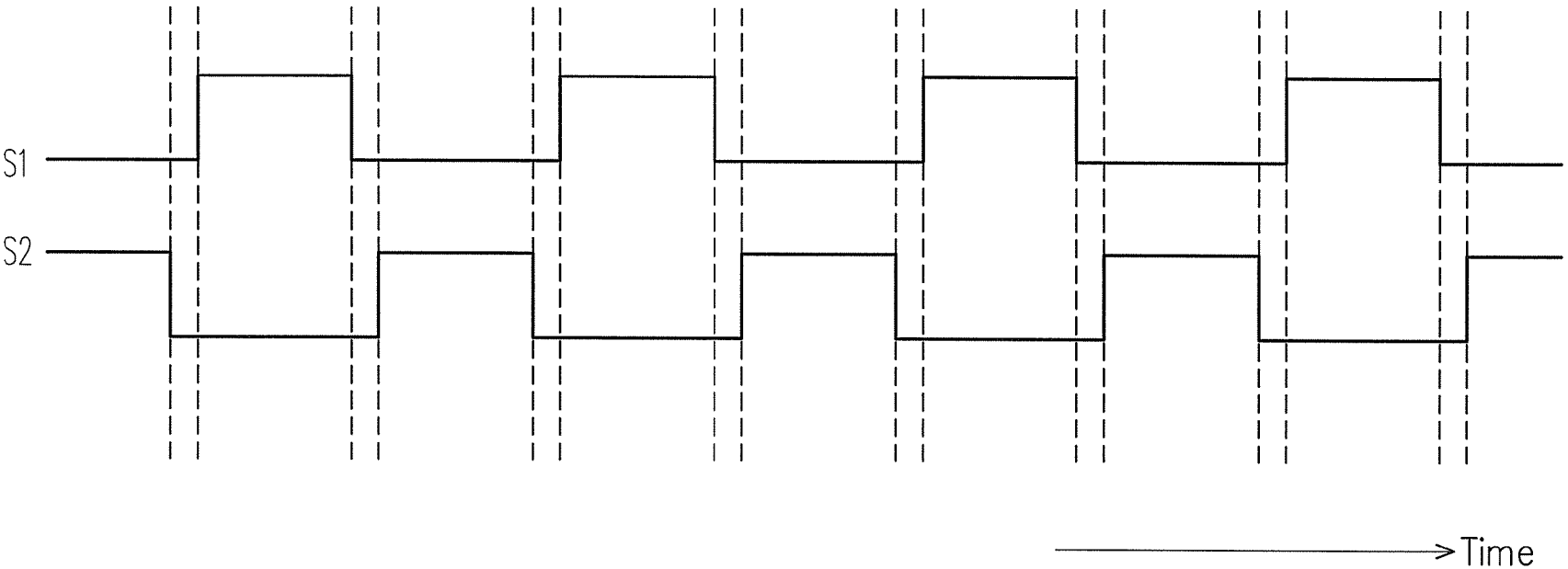
FIG. 9 is a timing diagram of a first control signal S1 and a second control signal S2 used to control the driving circuit depicted in FIG. 7.

In one embodiment of the invention, the switching circuit 104 performs switching according to a first control signal S1 and a second control signal S2. Referring to FIG. 9, FIG. 9 is a timing diagram of the first control signal S1 and the second control signal S2. During the first frame period of the liquid crystal display, the first control signal S1 is at a high potential, whereas the second control signal S2 is at a low potential. In addition, during the second frame period of the liquid crystal display, the first control signal S1 is at the low potential, whereas the second control signal S2 is at the high potential. As shown in FIG. 9, the above-described first and second frame periods are not overlapped along the time axis.

The first gamma buffer 106(1) is coupled to the switching circuit 104, and the first gamma buffer 106(1) is adapted to receive the first gamma voltages from the first input port 102(1) through the switching circuit 104, or adapted to receive the second gamma voltages from the second input port 102(2). Moreover, the first gamma buffer 106(1) buffers and then outputs the received first gamma voltages or the received second gamma voltages to the DACs 108(1)-108(*n*). Similarly, the second gamma buffer 106(2) is also coupled to the switching circuit 104, and the second gamma buffer 106(2) is adapted to receive the first gamma voltages from the first input port 102(1) through the switching circuit 104, or adapted to receive the second gamma voltages from the second input port 102(2). Moreover, the second gamma buffer 106(2) buffers and then outputs the received first gamma voltages or the received second gamma voltages to the DACs 108(1)-108(*n*).

The first DACs 108(1), . . . , 108(*n*−3) and 108(*n*−1) and the second DACs 108(2), . . . , 108(*n*−2) and 108(*n*) are coupled to an output port of the first gamma buffer 106(1) and an output port of the second gamma buffer 106(2). During the first frame period of the liquid crystal display, each of the first DACs 108(1), . . . , 108(*n*−3) and 108(*n*−1) respectively selects one of the first gamma voltages transmitted from the first gamma buffer 106(1) to output to the corresponding first operational amplifiers 110(1), . . . , 110(*n*−3) or 110(*n*−1). Each of the second DACs 108(2), . . . , 108(*n*−2) and 108(*n*)

respectively selects one of the second gamma voltages transmitted from the second gamma buffer 106(2) to output to the corresponding second operational amplifiers 110(2), . . . , 110($n$−2) or 110($n$).

During the second frame period of the liquid crystal display, each of the first DACs 108(1), . . . , 108($n$−3) and 108($n$−1) respectively selects one of the first gamma voltages transmitted from the second gamma buffer 106(2) to output to the corresponding first operational amplifiers 110(1), . . . , 110($n$−3) or 110($n$−1). Each of the second DACs 108(2), . . . , 108($n$−2) and 108($n$) respectively selects one of the second gamma voltages transmitted from the first gamma buffer 106(1) to output to the corresponding second operational amplifiers 110(2), . . . , 110($n$−2) or 110($n$).

The first operational amplifiers 110(1), . . . , 110($n$−3) and 110($n$−1) are coupled between the first DACs 108(1), . . . , 108($n$−3) and 108($n$−1) and the first pixels 112(1), . . . , 112($n$−3) and 112($n$−1) of the lines of pixels of the liquid crystal display. During the first frame period of the liquid crystal display, each of the first operational amplifiers 110(1), . . . , 110($n$−3) or 110($n$−1) respectively amplifies and outputs the first gamma voltages transmitted from the first DACs 108(1), . . . , 108($n$−3) or 108($n$−1) to the corresponding line of first pixels 112(1), . . . , 112($n$−3) or 112($n$−1). During the second frame period of the liquid crystal display, each of the first operational amplifiers 110(1), . . . , 110($n$−3) or 110($n$−1) respectively amplifies and outputs the second gamma voltages transmitted from the first DACs 108(1), . . . , 108($n$−3) or 108($n$−1) to the corresponding line of first pixels 112(1), . . . , 112($n$−3) or 112($n$−1).

Similarly, the second operational amplifiers 110(2), . . . , 110($n$−2) and 110($n$) are coupled between the second DACs 108(2), . . . , 108($n$−2) and 108($n$) and the second pixels 112(2), . . . , 112($n$−2) and 112($n$) of the lines of pixels of the liquid crystal display. During the first frame period of the liquid crystal display, each of the second operational amplifiers 110(2), . . . , 110($n$−2) or 110($n$) respectively amplifies and outputs the second gamma voltages transmitted from the second DACs 108(2), . . . , 108($n$−2) or 108($n$) to the corresponding line of second pixels 112(2), . . . , 112($n$−2) or 112($n$). During the second frame period of the liquid crystal display, each of the second operational amplifiers 110(2), . . . , 110($n$−2) or 110($n$) respectively amplifies and outputs the first gamma voltages transmitted from the second DACs 108(2), . . . , 118($n$−2) or 118($n$) to the corresponding line of second pixels 112(2), . . . , 112($n$−2) or 112($n$).

Figure 1:
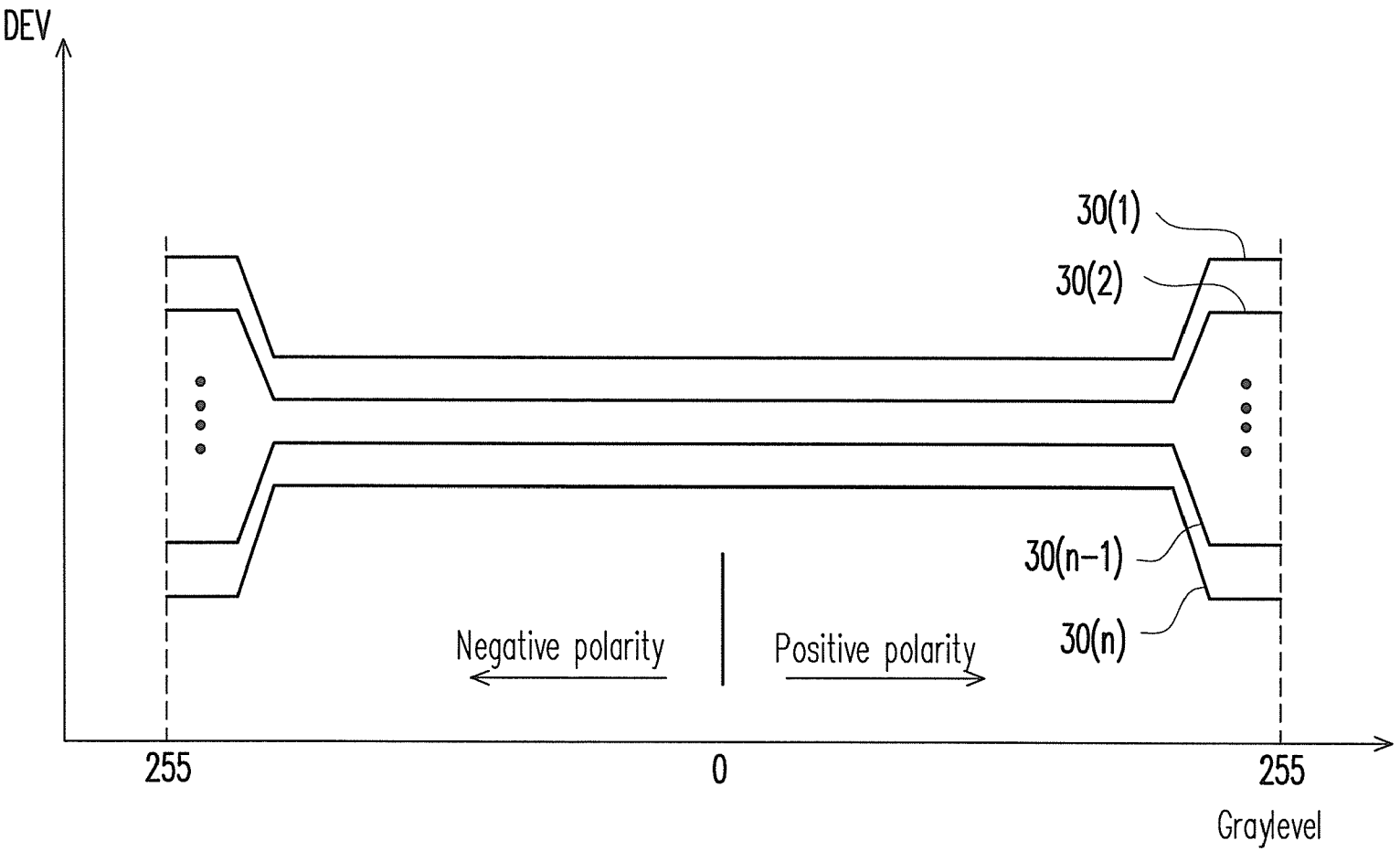
FIG. 1 (RELATED ART)
FIG. 1 is a diagram illustrating relationships between a DEV voltage of a driving circuit using an idealized gamma buffer and each graylevel.
Figure 5:
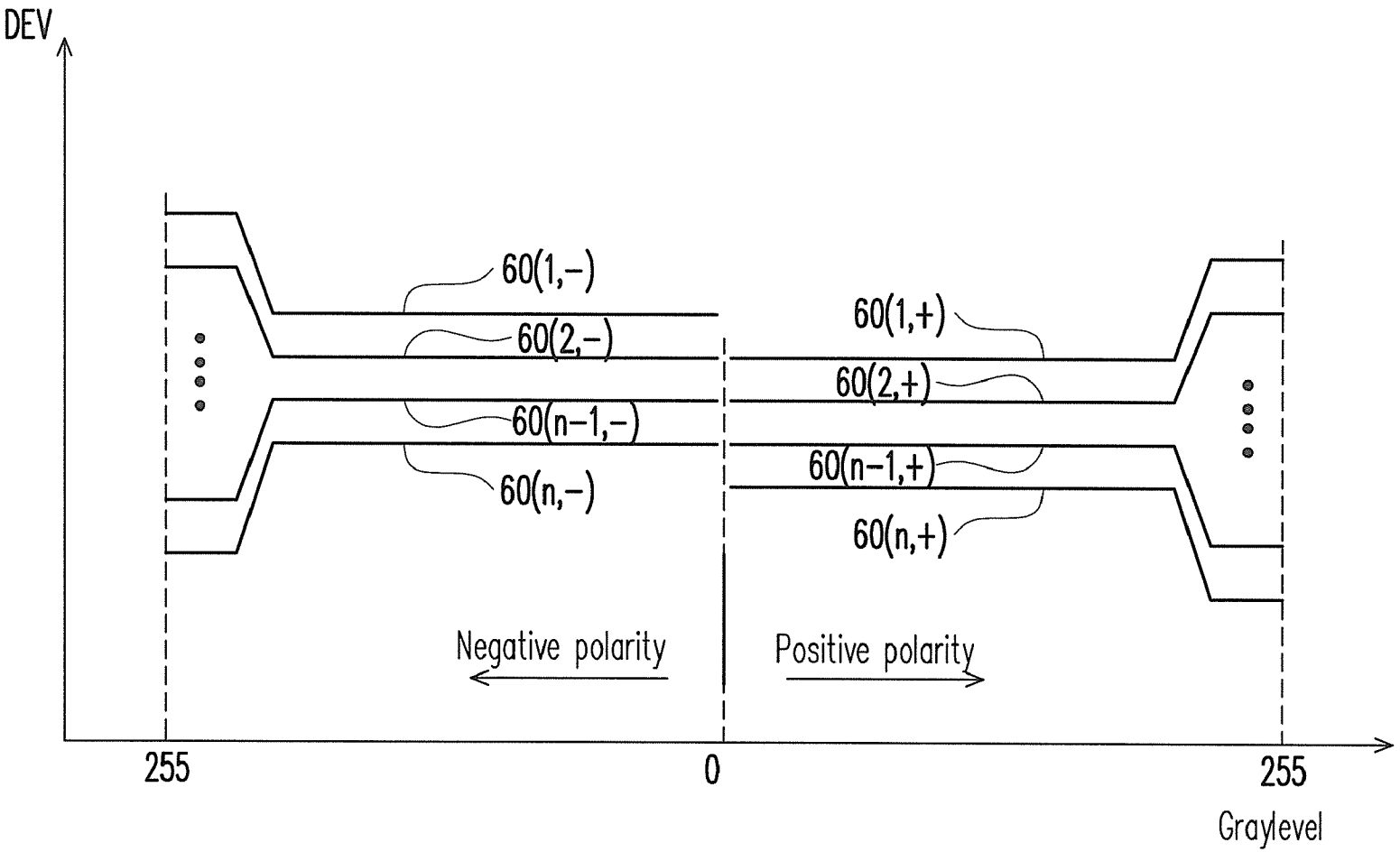
FIG. 5 (RELATED ART)
FIG. 5 is a diagram illustrating relationships between the DEV voltage of the driving circuit depicted in FIG. 3 and each graylevel.
Figure 10:
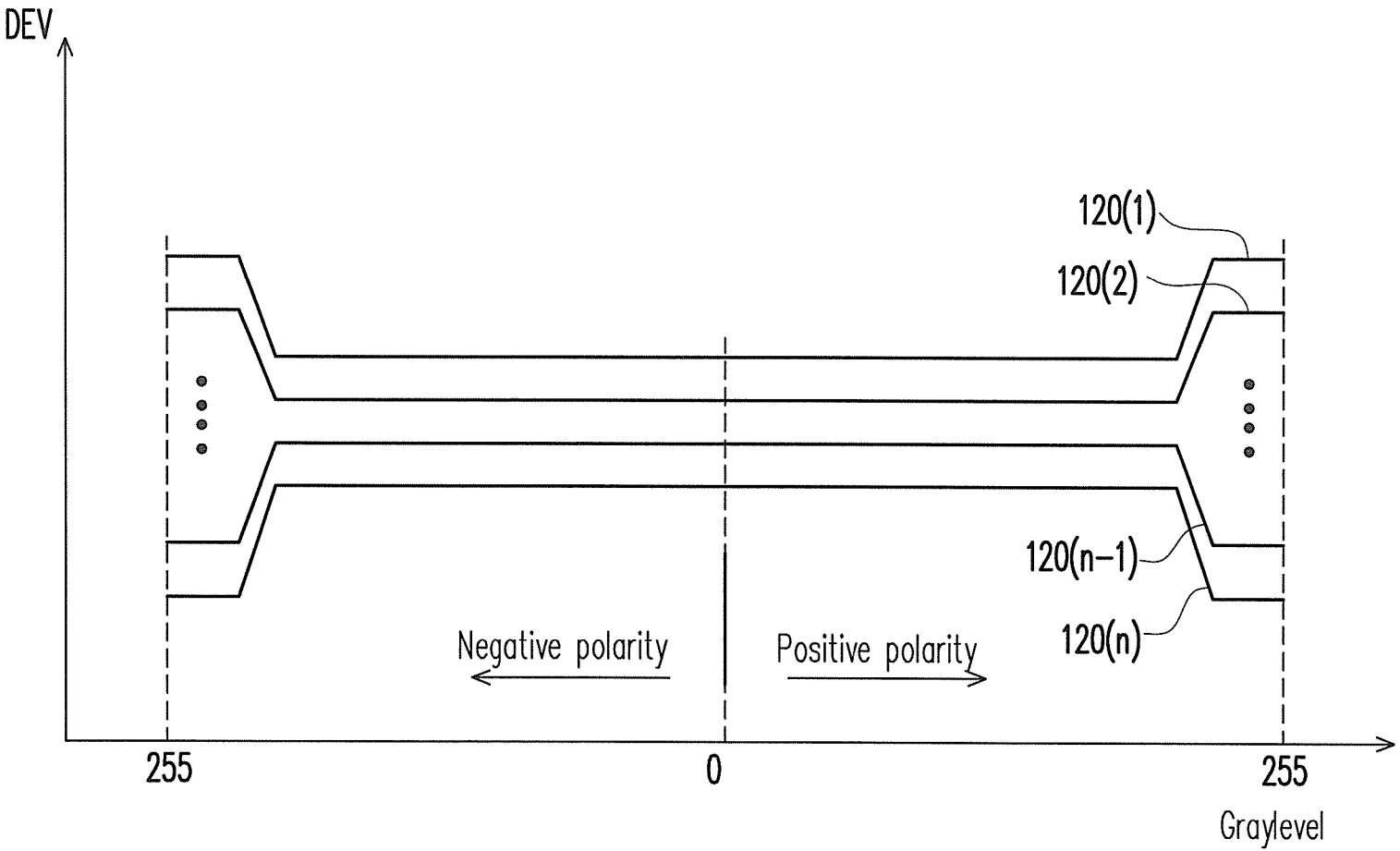
FIG. 10 is a diagram illustrating relationships between a DEV voltage of the driving circuit depicted in FIG. 7 and each graylevel.

As shown in FIGS. 7 and 8, whether the liquid crystal display is in the first or the second frame period, the first gamma voltages or the second gamma voltages transmitted to the first pixels 112(1), . . . , 112($n$−3) or 112($n$−1) are buffered by the first gamma buffer 106(1). Moreover, whether the liquid crystal display is in the first or the second frame period, the first gamma voltages or the second gamma voltages transmitted to the second pixels 112(2), . . . , 112($n$−2) or 112($n$) are buffered by the second gamma buffer 106(2). Therefore, during the first or the second frame period, the gamma voltages received by pixels of a same line have been buffered by the same gamma buffer. Consequently, the display quality of the liquid crystal display can approach an optimal condition. Referring to FIG. 10, FIG. 10 is a diagram illustrating relationships between the DEV voltage of the driving circuit 100 and each graylevel. The DEV voltage is defined as a difference value obtained by subtracting the gamma voltage the driving circuit 100 outputs to the pixels by a predetermined idealized voltage. Each of the curves 120(1)-120($n$) depicted in FIG. 10 respectively corresponds to a line of pixels 112(1), 112(2), . . . , 112($n$−3), 112($n$−2), 112($n$−1) or 112($n$). Compared to the curves depicted in FIG. 5, the curves depicted in FIG. 10 more closely resemble the idealized curves depicted in FIG. 1.

Figure 2:
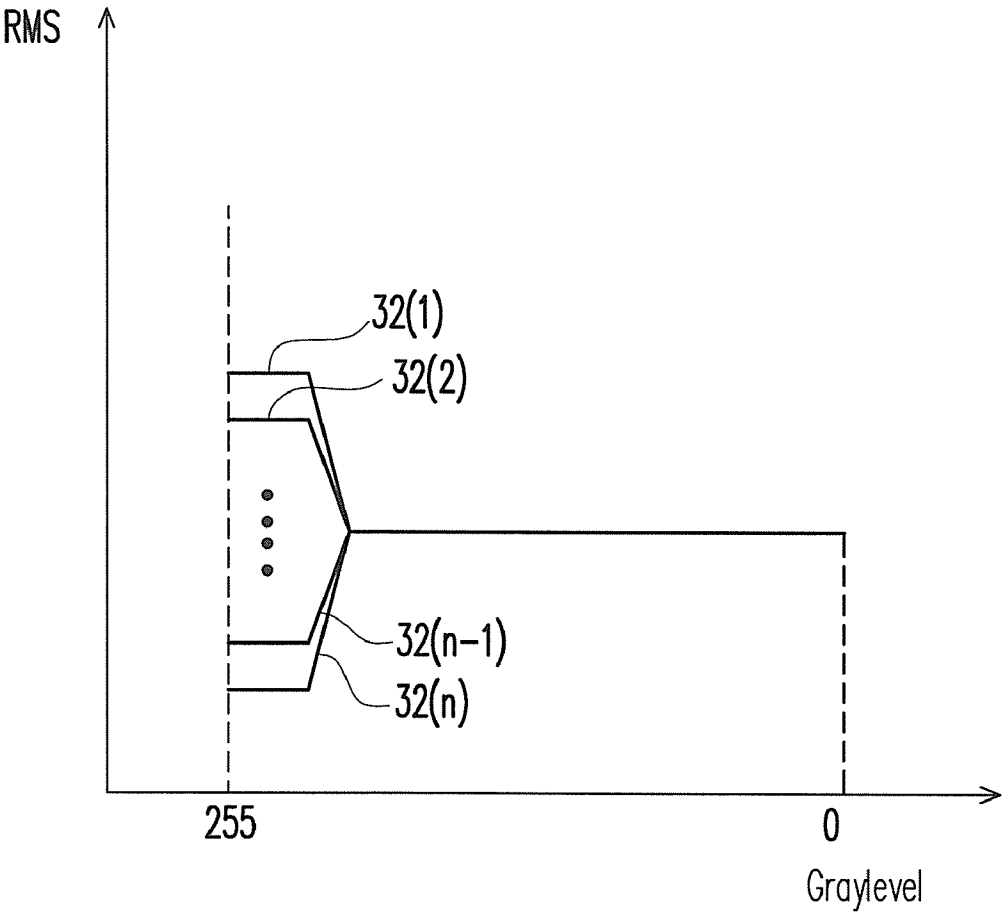
FIG. 2 (RELATED ART)
FIG. 2 is a diagram illustrating relationships between a root mean square (RMS) of a driving circuit using an idealized gamma buffer and each graylevel.
Figure 3:
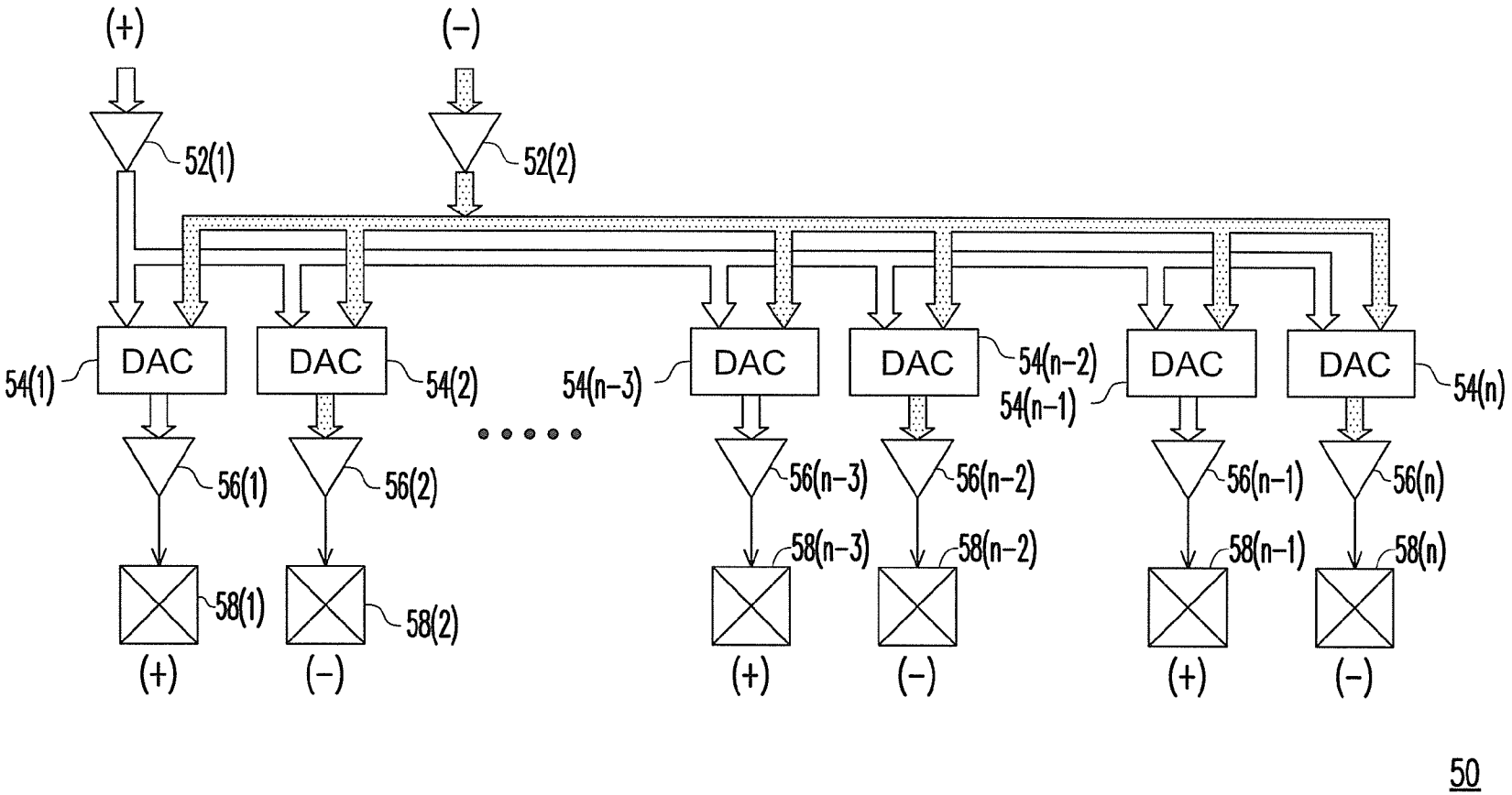
FIG. 3 (RELATED ART)
FIG. 3 is a schematic diagram of a driving circuit of a conventional liquid crystal display during a first frame period.
Figure 4:
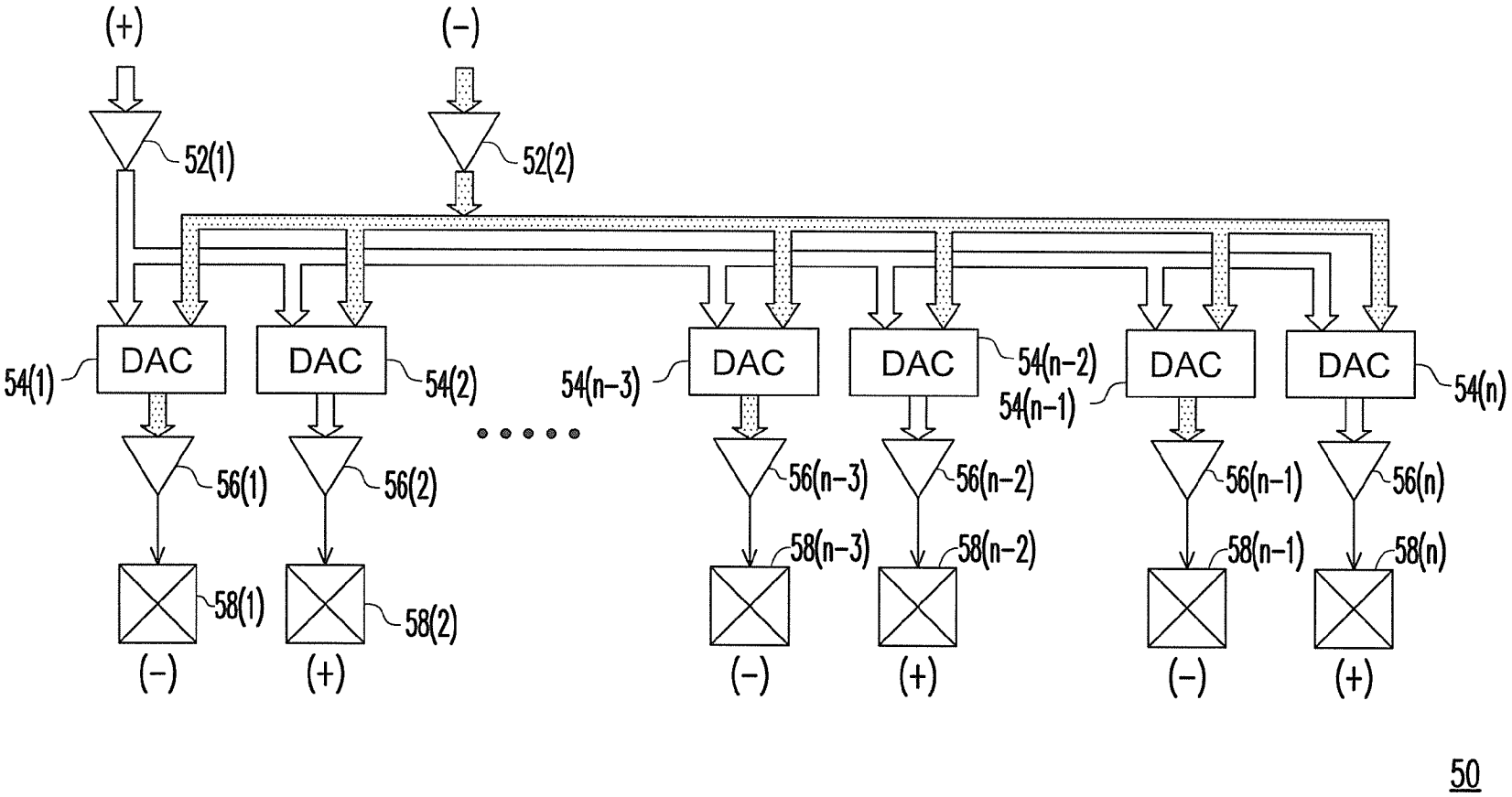
FIG. 4 (RELATED ART)
FIG. 4 is a schematic diagram of the driving circuit depicted in FIG. 3 during a second frame period.
Figure 6:
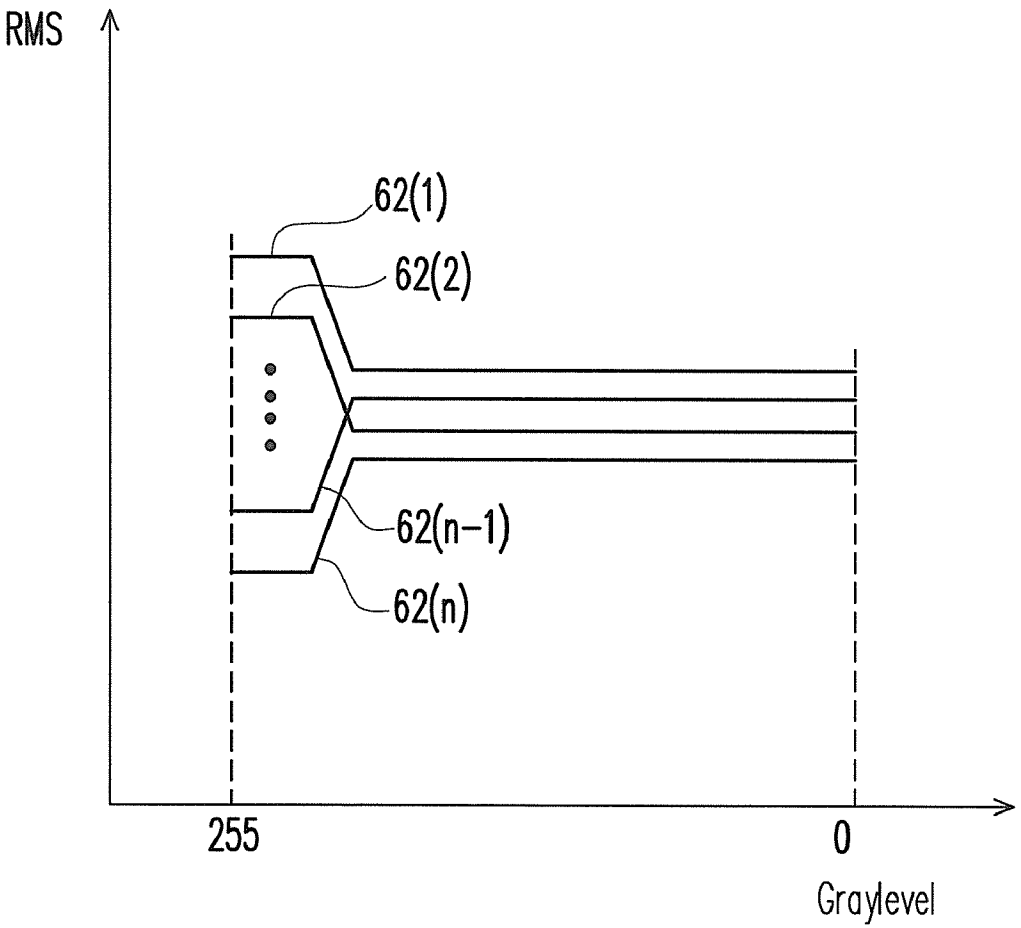
FIG. 6 (RELATED ART)
FIG. 6 is a diagram illustrating relationships between the RMS of the driving circuit depicted in FIG. 3 and each graylevel.
Figure 11:
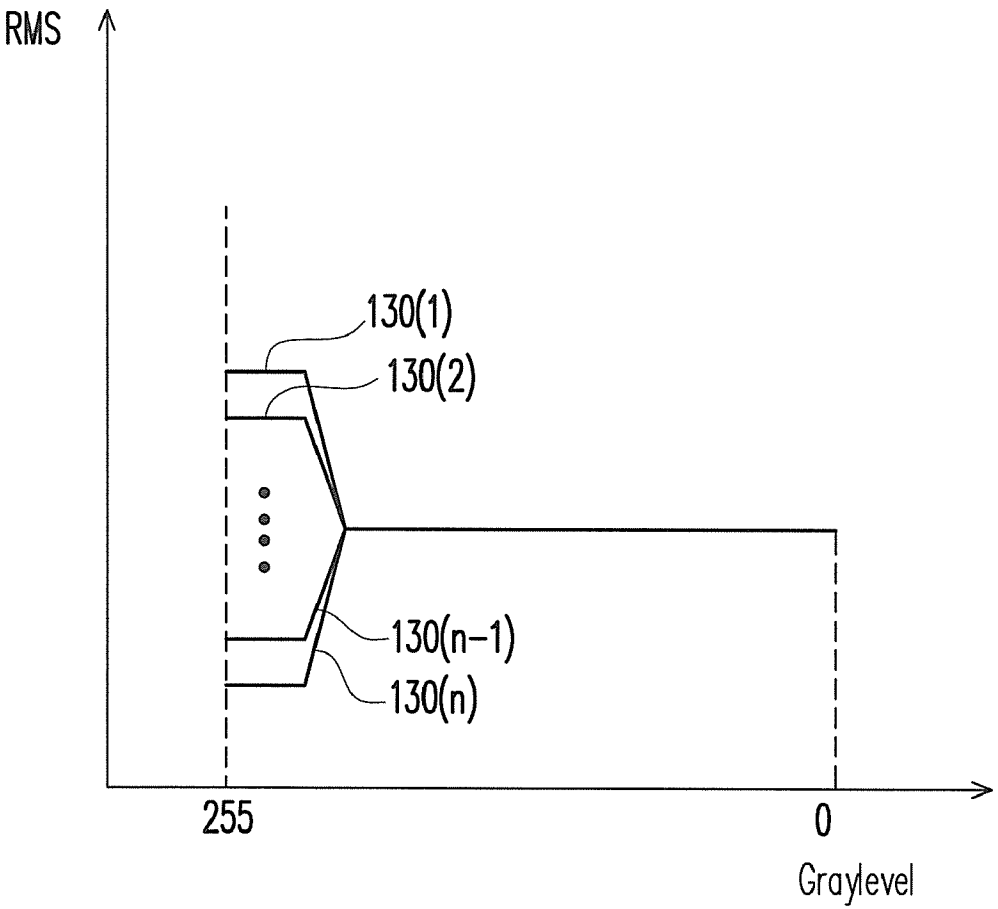
FIG. 11 is a diagram illustrating relationships between the RMS of the driving circuit depicted in FIG. 7 and each graylevel.

Moreover, referring to FIG. 11, FIG. 11 is a diagram illustrating relationships between the RMS of the driving circuit 100 and each graylevel. Each of a plurality of curves 130(1)-130($n$) respectively corresponds to a line of the lines of pixels 112(1)-112($n$). Compared to the curves depicted in FIG. 6, the curves depicted in FIG. 11 more closely resemble the idealized curves depicted in FIG. 2.

Figure 12:
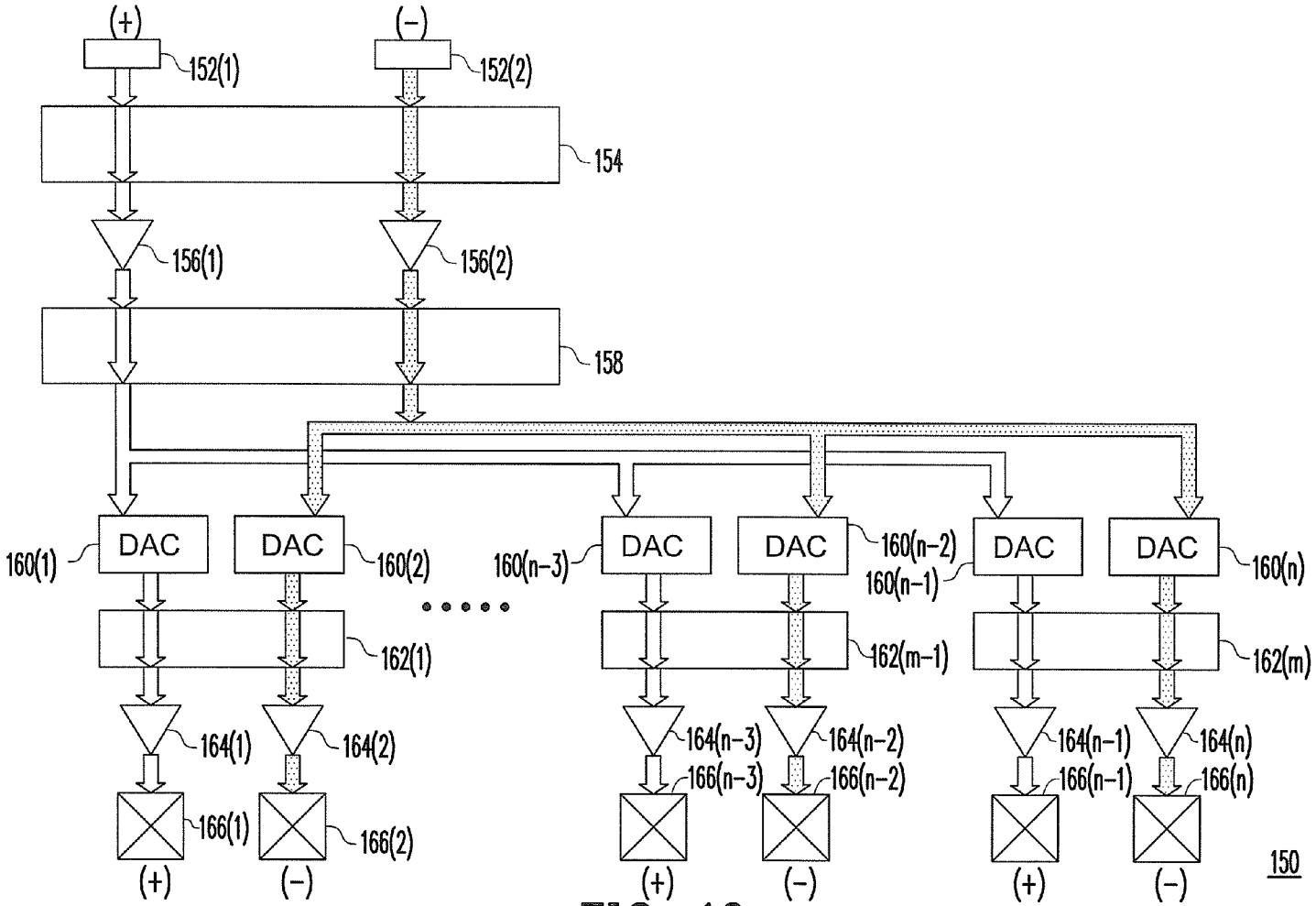
FIG. 12 is a schematic diagram of a driving circuit of a liquid crystal display during a first frame period in accordance with another embodiment of the invention.
Figure 13:
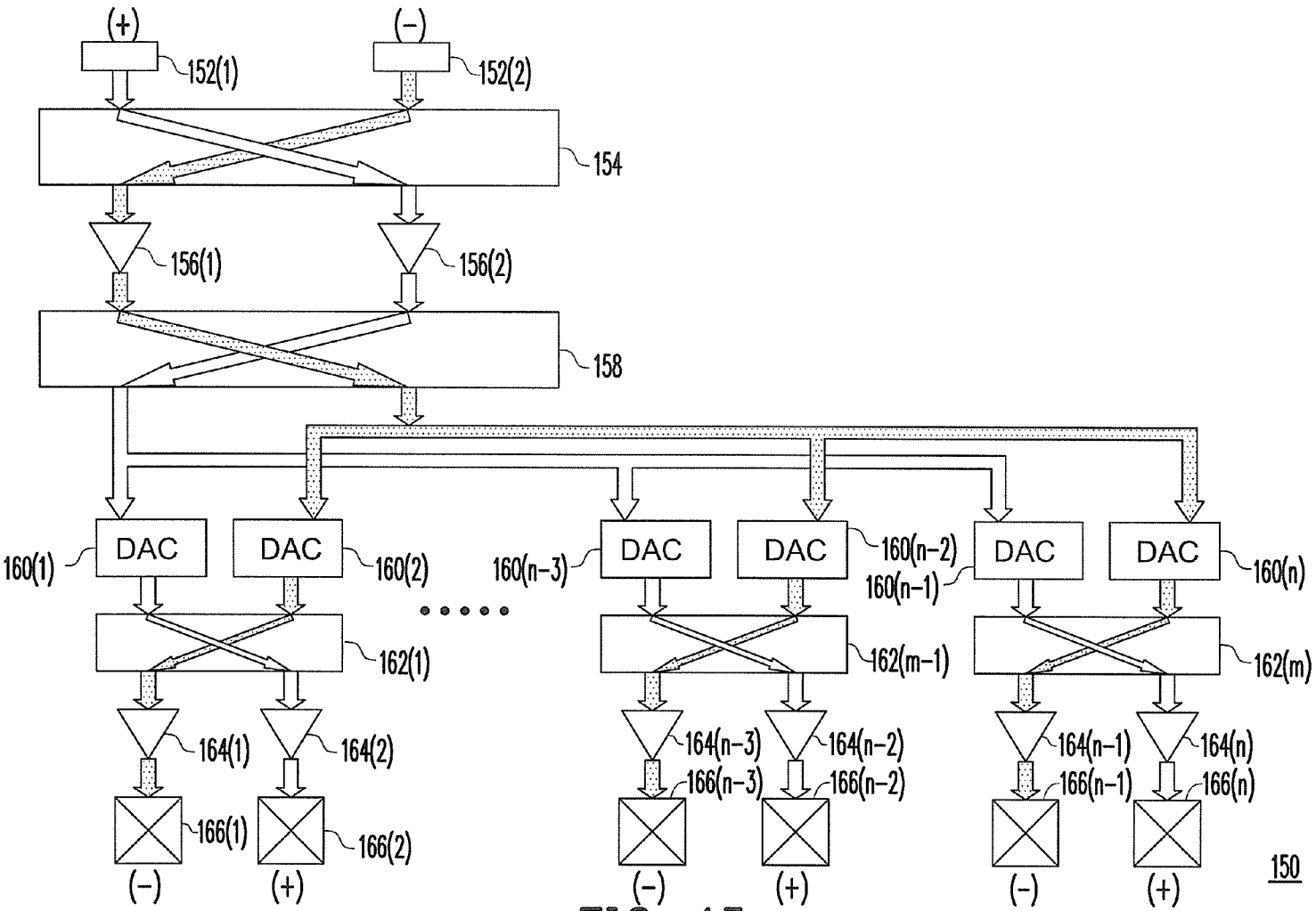
FIG. 13 is a schematic diagram of the driving circuit depicted in FIG. 12 during a second frame period.

Referring to FIGS. 12 and 13, FIG. 12 is a schematic diagram of a driving circuit 150 of a liquid crystal display during a first frame period in accordance with another embodiment of the invention. FIG. 13 is a schematic diagram of the driving circuit 150 during a second frame period. The driving circuit 150 has a first input port 152(1), a second input port 152(2), a first switching circuit 154, a first gamma buffer 156(1), a second gamma buffer 156(2), a second switching circuit 158, a plurality of DACs 160(1)-160($n$), a plurality of third switching circuits 162(1)-162($m$), and a plurality of operational amplifiers 164(1)-164($n$). The driving circuit 150 is configured to output a plurality of gamma voltages to a plurality of lines of pixels 166(1)-166($n$) of the liquid crystal display, so as to drive the liquid crystal molecules in the pixels to rotate.

Similarly, for ease of description, in the embodiments described hereinafter, all the odd-numbered DACs 160(1), . . . , 160($n$−3) and 160($n$−1) of the DACs 160(1)-160($n$) are referred to as the first DACs, and all the even-numbered DACs 160(2), . . . , 160($n$−2) and 160($n$) of the DACs 160(1)-160($n$) are referred to as the second DACs. Moreover, all the odd-numbered operational amplifiers 164(1), . . . , 164($n$−3) and 164($n$−1) of the operational amplifiers 164(1)-164($n$) are referred to as the first operational amplifiers, and all the even-numbered operational amplifiers 164(2), . . . , 164($n$−2), and 164($n$) of the operational amplifiers 164(1)-164($n$) are referred to as the second operational amplifiers. The odd-numbered lines of pixels in the lines of pixels 166(1)-166($n$) are referred to as the first pixels, and the even-numbered lines of pixels in the lines of pixels 166(1)-166($n$) are referred to as the second pixels.

The first input port 152(1) is adapted to input a plurality of first gamma voltages, and the second input port 152(2) is adapted to input a plurality of second gamma voltages. In the present embodiment of the invention, the aforementioned first gamma voltages are positive polarity voltages, whereas the aforementioned second gamma voltages are negative polarity voltages. However, the invention should not be construed as limited thereto. For example, in another embodiment of the invention, the aforementioned first gamma voltages are negative polarity voltages, whereas the aforementioned second gamma voltages are positive polarity voltages.

The first switching circuit 154 is coupled to the first input port 152(1) and the second input port 152(2). The first switching circuit 154 performs switching during different frame periods of the liquid crystal display to appropriately transmit the aforementioned first gamma voltages and the second gamma voltages to the first gamma buffer 156(1) and the second gamma buffer 156(2). More specifically, as shown in FIG. 12, during the first frame period of the liquid crystal display, the first switching circuit 154 couples the first input port 152(1) to the first gamma buffer 156(1), and couples the second input port 152(2) to the second gamma buffer 156(2). Moreover, as shown in FIG. 13, during the second frame period of the liquid crystal display, the first switching circuit

154 couples the first input port 152(1) to the second gamma buffer 156(2), and couples the second input port 152(2) to the first gamma buffer 156(1).

The second switching circuit 158 is coupled to an output port of the first gamma buffer 156(1) and an output port of the second gamma buffer 156(2), so as to transmit the gamma voltages buffered by the first gamma buffer 156(1) and the second gamma buffer 156(2). As shown in FIG. 12, during the first frame period of the liquid crystal display, the second switching circuit 158 couples the first gamma buffer 156(1) to the first DACs 160(1), . . . , 160($n$−3) and 160($n$−1), and couples the second gamma buffer 156(2) to the second DACs 160(2), . . . , 160($n$−2) and 160($n$). Moreover, as shown in FIG. 13, during the second frame period of the liquid crystal display, the second switching circuit 158 couples the first gamma buffer 156(1) to the second DACs 160(2), . . . , 160($n$−2) and 160($n$), and couples the second gamma buffer 156(2) to the first DACs 160(1), . . . , 160($n$−3) and 160($n$−1).

The first DACs 160(1), . . . , 160($n$−3) and 160($n$−1) and the second DACs 160(2), . . . , 160($n$−2) and 160($n$) are coupled to the second switching circuit 158. During the first frame period of the liquid crystal display, each of the first DACs 160(1), . . . , 160($n$−3) and 160($n$−1) respectively selects one of the first gamma voltages transmitted from the first gamma buffer 156(1) to output. Each of the second DACs 160(2), . . . , 160($n$−2) and 160($n$) respectively selects one of the second gamma voltages transmitted from the second gamma buffer 156(2) to output. During the second frame period of the liquid crystal display, each of the first DACs 160(1), . . . , 160($n$−3) and 160($n$−1) respectively selects one of the first gamma voltages transmitted from the second gamma buffer 156(1) to output. Each of the second DACs 160(2), . . . , 160($n$−2) and 160($n$) respectively selects one of the second gamma voltages transmitted from the first gamma buffer 156(1) to output.

Each of the third switching circuits 162(1)-162($m$) is coupled to a corresponding one of the first DACs 160(1), . . . , 160($n$−3) or 160($n$−1) and a corresponding one of the second DACs 160(2), . . . , 160($n$−2) or 160($n$). During the first frame period of the liquid crystal display, the third switching circuits 162(1)-162($m$) couple the first DACs 160(1), . . . , 160($n$−3) and 160($n$−1) to the first operational amplifiers 164(1), . . . , 164($n$−3) and 164($n$−1), and couple the second DACs 160(2), . . . , 160($n$−2) and 160($n$) to the second operational amplifiers 164(2), . . . , 164($n$−2) and 164($n$).

During the second frame period of the liquid crystal display, the third switching circuits 162(1)-162($m$) couple the first DACs 160(1), . . . , 160($n$−3) and 160($n$−1) to the second operational amplifiers 164(2), . . . , 164($n$−2) and 164($n$), and couples the second DACs 160(2), . . . , 160($n$−2) and 160($n$) to the first operational amplifiers 164(1), . . . , 164($n$−3) and 164($n$−1).

The first operational amplifiers 164(1), . . . , 164($n$−3) and 164($n$−1) are coupled between the third switching circuits 162(1)-162($m$) and the first pixels 166(1), . . . , 166($n$−3) and 166($n$−1) of the lines of pixels of the liquid crystal display. During the first frame period of the liquid crystal display, each of the first operational amplifiers 164(1), . . . , 164($n$−3) or 164($n$−1) respectively amplifies and outputs the first gamma voltages transmitted from the first DACs 160(1), . . . , 160($n$−3) or 160($n$−1) to the corresponding line of first pixels 166(1), . . . , 166($n$−3) or 166($n$−1). During the second frame period of the liquid crystal display, each of the first operational amplifiers 164(1), . . . , 164($n$−3) or 164($n$−1) respectively amplifies and outputs the second gamma voltages transmitted from the second DACs 160(2), . . . , 160($n$−2) or 160($n$) to the corresponding line of first pixels 166(1), . . . , 166($n$−3) or 166($n$−1).

Similarly, the second operational amplifiers 164(2), . . . , 164($n$−2) and 164($n$−1) are coupled between the third switching circuits 162(1)-162($m$) and the second pixels 166(2), . . . , 166($n$−2) and 166($n$) of the lines of pixels of the liquid crystal display. During the first frame period of the liquid crystal display, each of the second operational amplifiers 164(2), . . . , 164($n$−2) or 164($n$) respectively amplifies and outputs the second gamma voltages transmitted from the second DACs 160(2), . . . , 160($n$−2) or 160($n$) to the corresponding line of second pixels 166(2), . . . , 166($n$−2) or 166($n$). During the second frame period of the liquid crystal display, each of the second operational amplifiers 164(2), . . . , 164($n$−2) or 164($n$) respectively amplifies and outputs the first gamma voltages transmitted from the first DACs 160(1), . . . , 160($n$−3) or 160($n$−1) to the corresponding line of second pixels 166(2), . . . , 166($n$−2) or 166($n$).

In one embodiment of the invention, the first switching circuit 154, the second switching circuit 158, and the third switching circuits 162(1)-162($m$) perform switching according to a first control signal S1 and a second control signal S2 depicted in FIG. 9.

As shown in FIGS. 12 and 13, whether the liquid crystal display is in the first or the second frame period, the first gamma voltages or the second gamma voltages transmitted to the first pixels 166(1), . . . , 166($n$−3) or 166(1) are buffered by the first gamma buffer 156(1). Moreover, whether the liquid crystal display is in the first or the second frame period, the first gamma voltages or the second gamma voltages transmitted to the second pixels 166(2), . . . , 166($n$−2) or 166($n$) are buffered by the second gamma buffer 156(2). Therefore, during the first or the second frame period, the gamma voltages received by pixels of a same line have been buffered by the same gamma buffer. Consequently, the display quality of the liquid crystal display can approach an optimal condition.

In one embodiment of the invention, the above-described first DACs 160(1), . . . , 160($n$−3), or 160($n$−1) are P-type DACs configured to process positive polarity gamma voltages. The above-described second DACs 160(2), . . . , 160($n$−2) or 160($n$) are N-type DACs configured to process negative polarity gamma voltages.

Figure 14:
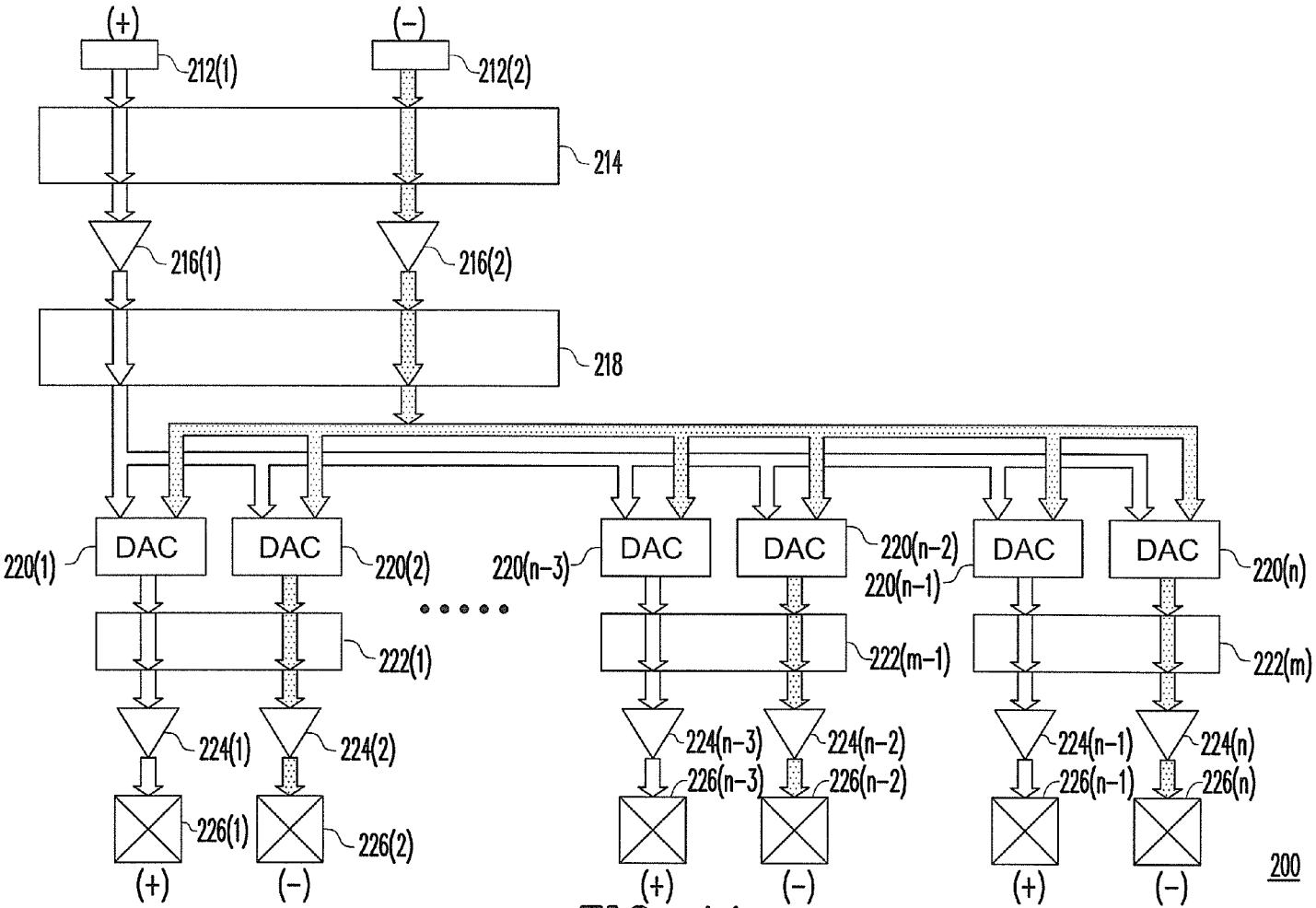
FIG. 14 is a schematic diagram of a driving circuit of a liquid crystal display during a first frame period in accordance with another embodiment of the invention.
Figure 15:
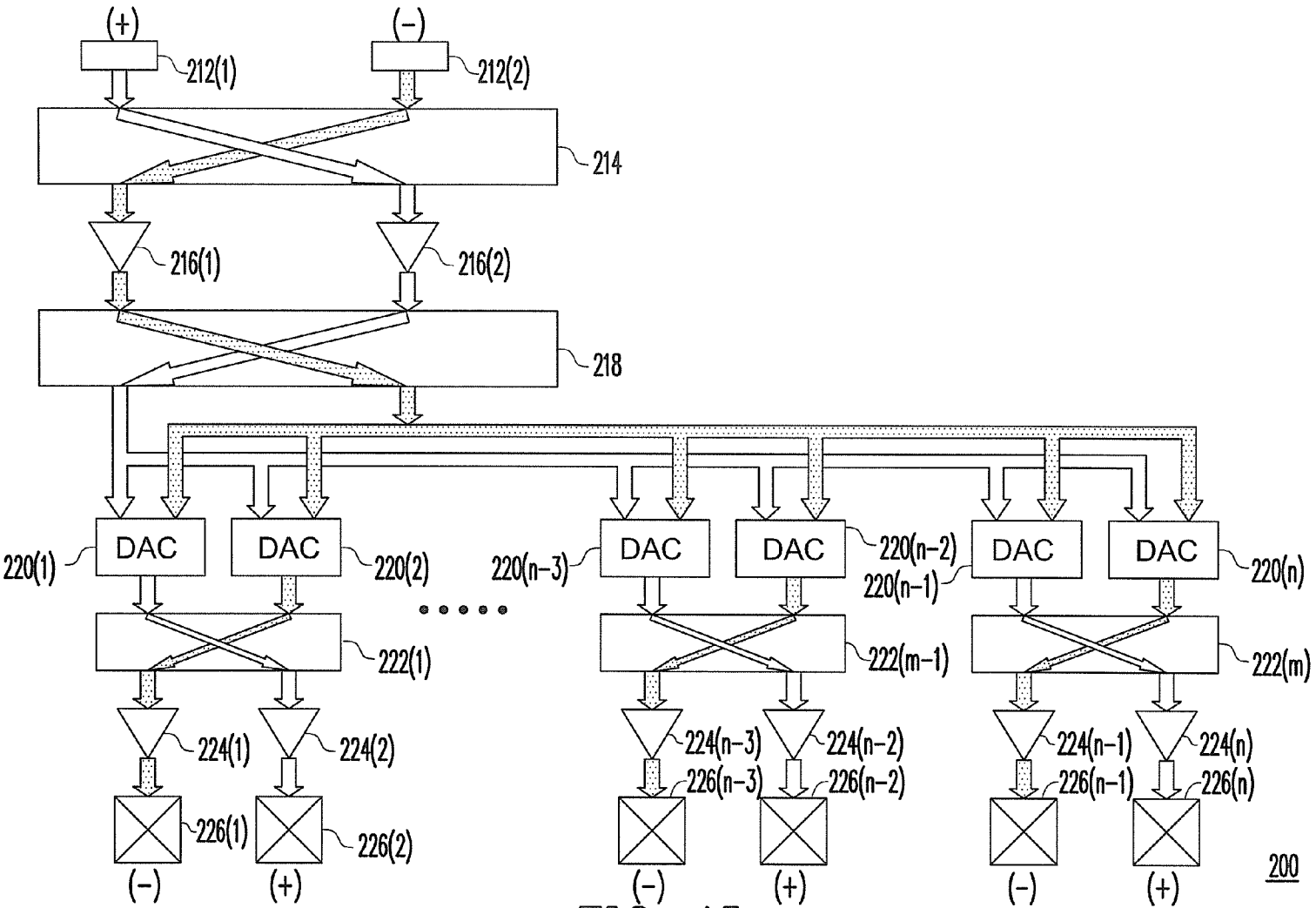
FIG. 15 is a schematic diagram of the driving circuit depicted in FIG. 14 during a second frame period.

Referring to FIGS. 14 and 15, FIG. 14 is a schematic diagram of a driving circuit 200 of a liquid crystal display during a first frame period in accordance with another embodiment of the invention. FIG. 15 is a schematic diagram of the driving circuit 200 during a second frame period. The driving circuit 200 has a first input port 212(1), a second input port 212(2), a first switching circuit 214, a first gamma buffer 216(1), a second gamma buffer 216(2), a second switching circuit 218, a plurality of DACs 220(1)-220($n$), a plurality of third switching circuits 222(1)-222($m$), and a plurality of operational amplifiers 224(1)-224($n$). The driving circuit 200 is configured to output a plurality of gamma voltages to a plurality of lines of pixels 226(1)-226($n$) of the liquid crystal display, so as to drive the liquid crystal molecules in the pixels to rotate.

For ease of description, in the embodiments described hereinafter, all the odd-numbered DACs 220(1), . . . , 220($n$−3), and 220($n$−1) of the DACs 220(1)-220($n$) are referred to as the first DACs, and all the even-numbered DACs 220(2), . . . , 220($n$−2), and 220($n$) of the DACs 220(1)-220($n$) are referred to as the second DACs. Moreover, all the odd-numbered operational amplifiers 224(1), . . . , 224($n$−3) and 224($n$−1) of the operational amplifiers 224(1)-224($n$) are referred to as the first operational amplifiers, and all the even-numbered operational amplifiers 224(2), . . . , 224($n$−2), and 224($n$) of the operational amplifiers 224(1)-224($n$) are referred to as the second operational amplifiers. The odd-numbered lines of pixels in the lines of pixels 226(1)-**226(*n*) are referred to as the first pixels, and the even-numbered lines of pixels in the lines of pixels 226(1)-226(*n*)** are referred to as the second pixels.

The first input port 212(1) is adapted to input a plurality of first gamma voltages, and the second input port 212(2) is adapted to input a plurality of second gamma voltages. The first switching circuit 214 is coupled to the first input port 212(1) and the second input port 212(2). The first switching circuit 154 performs switching during different frame periods of the liquid crystal display to appropriately transmit the aforementioned first gamma voltages and the second gamma voltages to the first gamma buffer 216(1) and the second gamma buffer 216(2). More specifically, as shown in FIG. 14, during the first frame period of the liquid crystal display, the first switching circuit 214 couples the first input port 212(1) to the first gamma buffer 216(1), and couples the second input port 212(2) to the second gamma buffer 216(2). Moreover, as shown in FIG. 15, during the second frame period of the liquid crystal display, the first switching circuit 214 couples the first input port 212(1) to the second gamma buffer 216(2), and couples the second input port 212(2) to the first gamma buffer 216(1).

The second switching circuit 218 is coupled to an output port of the first gamma buffer 216(1) and an output port of the second gamma buffer 216(2). During the first and second frame periods of the liquid crystal display, the second switching circuit 218 transmits the first gamma voltages to an input port on the left side of the DACs 220(1)-**220(*n*), and transmits the second gamma voltages to an input port on the right side of the DACs 220(1)-220(*n*)**.

The DACs 220(1)-**220(*n*) are coupled to the second switching circuit 218. Whether during the first or second frame period of the liquid crystal display, each of the first DACs 220(1), . . . , 220(*n*−3) and 220(*n*−1) respectively selects one of the first gamma voltages transmitted from the first buffer 216(1) to output. Each of the second DACs 220(2), . . . , 220(*n*−2) and 220(*n*) respectively selects one of the second gamma voltages transmitted from the second gamma buffer 216(2)** to output.

Each of the third switching circuits 222(1)-**222(*m*) is coupled to a corresponding one of the first DACs 220(1), . . . , 220(*n*−3) or 220(*n*−1) and a corresponding one of the second DACs 220(2), . . . , 220(*n*−2) or 220(*n*). During the first frame period of the liquid crystal display, the third switching circuits 222(1)-222(*m*) couple the first DACs 220(1), . . . , 220(*n*−3) and 220(*n*−1) to the first operational amplifiers 224(1), . . . , 220(*n*−3) and 220(*n*−1), and couples the second DACs 220(2), . . . , 220(*n*−2) and 220(*n*) to the second operational amplifiers 224(2), . . . , 224(*n*−2) and 224(*n*)**.

During the second frame period of the liquid crystal display, the third switching circuits 222(1)-**222(*m*) couple the first DACs 220(1), . . . , 220(*n*−3) and 220(*n*−1) to the second operational amplifiers 224(2), . . . , 224(*n*−2) and 224(*n*), and couples the second DACs 220(2), . . . , 220(*n*−2) and 220(*n*) to the first operational amplifiers 224(1), . . . , 224(*n*−3) and 224(*n*−1)**.

The first operational amplifiers 224(1), . . . , **224(*n*−3) and 224(*n*−1) are coupled between the third switching circuits 222(1)-222(*m*) and the first pixels 226(1), . . . , 226(*n*−3) and 226(*n*−1) of the lines of pixels of the liquid crystal display. During the first frame period of the liquid crystal display, each of the first operational amplifiers 224(1), . . . , 224(*n*−3) or 224(*n*−1) respectively amplifies and outputs the first gamma voltages transmitted from the first DACs 220(1), . . . , 220(*n*−3) or 220(*n*−1) to the corresponding line of first pixels 226(1), . . . , 226(*n*−3) or 226(*n*−1). During the second frame period of the liquid crystal display, each of the first operational amplifiers 224(1), . . . , 224(*n*−3) or 224(*n*−1) respectively amplifies and outputs the second gamma voltages transmitted from the second DACs 220(2), . . . , 220(*n*−2) or 220(*n*) to the corresponding line of first pixels 226(1), . . . , 226(*n*−3) or 226(*n*−1)**.

Similarly, the second operational amplifiers 224(2), . . . , **224(*n*−2) and 224(*n*) are coupled between the third switching circuits 222(1)-222(*m*) and the second pixels 226(2), . . . , 226(*n*−2) and 226(*n*) of the lines of pixels of the liquid crystal display. During the first frame period of the liquid crystal display, each of the second operational amplifiers 224(2), . . . , 224(*n*−2) or 224(*n*) respectively amplifies and outputs the second gamma voltages transmitted from the second DACs 220(2), . . . , 220(*n*−2) or 220(*n*) to the corresponding line of second pixels 226(2), . . . , 226(*n*−2) or 226(*n*). During the second frame period of the liquid crystal display, each of the second operational amplifiers 224(2), . . . , 224(*n*−2) or 224(*n*) respectively amplifies and outputs the first gamma voltages transmitted from the first DACs 220(1), . . . , 220(*n*−3) or 220(*n*−1) to the corresponding line of second pixels 226(2), . . . , 226(*n*−2) or 226(*n*)**.

In one embodiment of the invention, the first switching circuit 214, the second switching circuit 218, and the third switching circuits 222(1)-**222(*m*) perform switching according to the first control signal S1 and the second control signal S2 depicted in FIG. 9**.

As shown in FIGS. 14 and 15, whether the liquid crystal display is in the first or the second frame period, the first gamma voltages or the second gamma voltages transmitted to the first pixels 226(1), . . . , **226(*n*−3) or 226(1) are buffered by the first gamma buffer 216(1). Moreover, whether the liquid crystal display is in the first or the second frame period, the first gamma voltages or the second gamma voltages transmitted to the second pixels 226(2), . . . , 226(*n*−2) or 226(*n*) are buffered by the second gamma buffer 216(2)**. Therefore, during the first or the second frame period, the gamma voltages received by pixels of a same line have been buffered by the same gamma buffer. Consequently, the display quality of the liquid crystal display can approach an optimal condition.

In light of the foregoing, a driving circuit of a liquid crystal display is provided. The gamma voltages transmitted to the liquid crystal display during different frame periods are buffered by the same gamma buffer, whereby the transmitted gamma voltages have substantially equal offset. Therefore, the display quality approaches an ideal condition.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A driving circuit of a liquid crystal display, comprising:

a first input port, adapted to input a plurality of first gamma voltages;

a second input port, adapted to input a plurality of second gamma voltages;

a switching circuit, coupled to the first input port and the second input port;

a first gamma buffer, coupled to the switching circuit and adapted to receive the first gamma voltages or the second gamma voltages and to buffer then output the received first gamma voltages or the received second gamma voltages;

a second gamma buffer, coupled to the switching circuit and adapted to receive the first gamma voltages or the second gamma voltages and to buffer then output the received first gamma voltages or the received second gamma voltages;

a plurality of first digital-to-analog converters (DACs), coupled to an output port of the first gamma buffer and an output port of the second gamma buffer;

a plurality of second DACs, coupled to the output ports of the first gamma buffer and the second gamma buffer;

a plurality of first operational amplifiers, coupled between the first DACs and a plurality of lines of first pixels of the liquid crystal display; and a plurality of second operational amplifiers, coupled between the second DACs and a plurality of lines of second pixels of the liquid crystal display;

wherein during a first frame period of the liquid crystal display, the switching circuit couples the first input port to the first gamma buffer and couples the second input port to the second gamma buffer, the first DACs respectively select one of the first gamma voltages transmitted from the first gamma buffer to output to a corresponding one of the lines of the first pixels, and the second DACs respectively select one of the second gamma voltages transmitted from the second gamma buffer to output to a corresponding one of the lines of the second pixels;

wherein during a second frame period of the liquid crystal display, the switching circuit couples the first input port to the second gamma buffer and couples the second input port to the first gamma buffer, the first DACs respectively select one of the second gamma voltages from the first gamma buffer to output to a corresponding one of the lines of the first pixels, and the second DACs respectively select one of the second gamma voltages from the second gamma buffer to output to a corresponding one of the lines of the second pixels.

2. The driving circuit as claimed in claim 1, wherein during the first frame period, the switching circuit disconnects the first input port from the second gamma buffer and disconnects the second input port from the first gamma buffer;

wherein during the second frame period, the switching circuit disconnects the first input port from the first gamma buffer and disconnects the second input port from the second gamma buffer.

3. The driving circuit as claimed in claim 1, wherein during the first frame period, a polarity of the first pixels is a first polarity, and a polarity of the second pixels is a second polarity;

wherein during the second frame period, the polarity of the first pixels is the second polarity, and the polarity of the second pixels is the first polarity.

4. The driving circuit as claimed in claim 1, wherein the first gamma voltages are greater than a common voltage, the second gamma voltages are less than the common voltage, and a plurality of electrodes of the first pixels and the second pixels are coupled to the common voltage.

5. The driving circuit as claimed in claim 1, wherein the first frame period and the second frame period are not overlapped along a time axis.

6. A driving circuit of a liquid crystal display, comprising:

a first input port, adapted to input a plurality of first gamma voltages;

a second input port, adapted to input a plurality of second gamma voltages;

a switching circuit, coupled to the first input port and the second input port;

a first gamma buffer, coupled to the first switching circuit;

a second gamma buffer, coupled to the first switching circuit;

a second switching circuit, coupled to an output port of the first gamma buffer and an output port of the second gamma buffer;

a plurality of first DACs, coupled to the second switching circuit;

a plurality of second DACs, coupled to the second switching circuit;

a plurality of third switching circuits, each of the third switching circuits coupled to a corresponding one of the first DACs and a corresponding one of the second DACs;

a plurality of first operational amplifiers, coupled between the third switching circuits and a plurality of lines of first pixels of the liquid crystal display; and a plurality of second operational amplifiers, coupled between the third switching circuits and a plurality of lines of second pixels of the liquid crystal display;

wherein during the first frame period of the liquid crystal display, the first switching circuit couples the first input port to the first gamma buffer and couples the second input port to the second gamma buffer, the second switching circuit couples the first gamma buffer to the first DACs and couples the second gamma buffer to the second DACs, and the third switching circuits couple the first DACs to the first operational amplifiers and couple the second DACs to the second operational amplifiers;

wherein during the second frame period of the liquid crystal display, the first switching circuit couples the first input port to the second gamma buffer and couples the second input port to the first gamma buffer, the second switching circuit couples the first gamma buffer to the second DACs and couples the second gamma buffer to the first DACs, and the third switching circuits couple the first DACs to the second operational amplifiers and couple the second DACs to the first operational amplifiers.

7. The driving circuit as claimed in claim 6, wherein during the first frame period of the liquid crystal display, the first switching circuit disconnects the first input port from the second gamma buffer and disconnects the second input port from the first gamma buffer, the second switching circuit disconnects the first gamma buffer from the second DACs and disconnects the second gamma buffer from the first DACs, and the third switching circuits disconnect the first DACs from the second operational amplifiers and disconnect the second DACs from the first operational amplifiers;

wherein during the second frame period of the liquid crystal display, the first switching circuit disconnects the first input port from the first gamma buffer and disconnects the second input port from the second gamma buffer, the second switching circuit disconnects the first gamma buffer from the first DACs and disconnects the second gamma buffer from the second DACs, and the third switching circuits disconnect the first DACs from the first operational amplifiers and disconnect the second DACs from the second operational amplifiers.

8. The driving circuit as claimed in claim 6, wherein during the first frame period, a polarity of the first pixels is a first polarity, and a polarity of the second pixels is a second polarity;

wherein during the second frame period, the polarity of the first pixels is the second polarity, and the polarity of the second pixels is the first polarity.

9. The driving circuit as claimed in claim 6, wherein the first gamma voltages are greater than a common voltage, the second gamma voltages are less than the common voltage, and a plurality of electrodes of the first pixels and the second pixels are coupled to the common voltage.

10. The driving circuit as claimed in claim 6, wherein the first frame period and the second frame period are not overlapped along a time axis.

11. The driving circuit as claimed in claim 6, wherein the first DACs are P-type DACs configured to process positive polarity gamma voltages, and the second DACs are N-type DACs configured to process negative polarity gamma voltages.

* * * * *